US005138847A

United States Patent [19]

Rollins

[11] Patent Number: 5,138,847

[45] Date of Patent: Aug. 18, 1992

[54] REFRIGERANT RECOVERY AND PROCESSING APPARATUS AND METHODS

[75] Inventor: Scott S. Rollins, Salt Lake City, Utah

[73] Assignee: Ozone Saver Industries, Salt Lake City, Utah

[21] Appl. No.: 558,805

[22] Filed: Jul. 27, 1990

[51] Int. Cl.[5] ..... F25B 45/00

[52] U.S. Cl. ..... 62/292; 62/474

[58] Field of Search ..... 62/77, 149, 292, 474; 210/502.1, 510.1

[56] References Cited

U.S. PATENT DOCUMENTS

| | | | |
|---|---|---|---|
| 2,341,430 | 2/1944 | Elsey | 62/474 X |
| 3,232,070 | 2/1966 | Sparano | 62/292 X |
| 3,699,781 | 10/1972 | Taylor | 62/474 |
| 4,266,408 | 5/1981 | Krause | 62/474 |
| 4,637,881 | 1/1987 | Sciuto | 62/474 X |
| 4,698,983 | 10/1987 | Hechavarria | 62/292 |
| 4,745,772 | 5/1988 | Ferris | 62/474 X |
| 4,938,031 | 7/1990 | Manz et al. | 62/292 X |

*Primary Examiner*—William E. Tapolcai

*Attorney, Agent, or Firm*—Workman, Nydegger & Jensen

[57] ABSTRACT

The present invention pertains to an environmentally safe, lightweight, portable, user-friendly, self-contained, low-maintenance, refrigerant recycling, purification, and storage system capable of removing refrigerants from refrigeration units for subsequent cleaning of acids and impurities such that the refrigerant will be easily recovered and reused instead of being carelessly released into the atmosphere. In addition to recovery and reuse, the present invention can be used to then recharge the refrigeration system with clean refrigerant or function as a leak tester, or remove obstructions from blocked lines or function as a vacuum pump. Refrigerant is evacuated by placing the lightweight device beside the unit to be repaired and then evacuating the refrigerant through a disposable filter and into a storage tank. The entire operation is completed at a relatively low pressure and because of the lightweight, can be accomplished on-site thereby obviating the need to remove the device.

10 Claims, 2 Drawing Sheets

REFRIGERANT RECOVERY AND PROCESSING APPARATUS AND METHODS

BACKGROUND

1. The Field of the Invention

The present invention relates to novel apparatus and methods for the recovery and recycling of refrigerants used in common commercial devices, including household and automotive appliances. More particularly, the present invention is directed to a lightweight, on-site, portable system for the evacuation, filtering, storage, replacement, and/or recycling of refrigerants from appliances.

2. Technology Review

Refrigeration systems such as those used in automotive and home appliances and air conditioners require that the refrigerant used be relatively free of foreign matter such as oil, water, and air. Since these systems rely on pressure to keep the refrigerant compressed, it is vital that hermetic integrity be maintained.

If the refrigeration system breaks down, the refrigerant must be removed to facilitate the repair of the system. In the past, the refrigerant (a colorless, odorless, gas) was merely discharged into the atmosphere. This discharge only wasted the relatively expensive refrigerant, but as has been recently discovered, may also have contributed significantly to the breakdown of the ozone layer of the earth's atmosphere. Because fluorocarbons used in automotive and household appliances are environmentally hazardous, it is desirable to prevent their harmful release.

Recycling capabilities provide a financial benefit for technicians who filter and reuse refrigerant instead of replacing it with relatively costly new refrigerant. Containment and recycling might also prove to be economically beneficial to the technician who recovers the refrigerant from refrigeration units beyond repair.

Unfortunately, the environmental and economic advantages of recycling refrigerant must compete with the temptation of simply releasing the refrigerant into the atmosphere. In light of this conflict, any successful recovery or recycling system must provide repair personnel with a lightweight portable, easy to use apparatus that would encourage the recycling of the refrigerant, otherwise, the easier course of merely releasing the refrigerant into the atmosphere will be followed While it is known to recover and recycle refrigerant as described in U.S. Pat. No. 3,232,070, these early systems only remove the refrigerant, filter and dry it, then condense the refrigerant for storage in an external holding tank. The system described in this reference lacks the capacity to reintroduce the refrigerant back into the appliance after repairs have been performed; moreover, it provides no design for cleaning the refrigerant before it enters the recovery apparatus. The result is that the recovery apparatus compressor pump is exposed to all of the contaminants that the refrigerant has accumulated, thereby shortening the life of the recovery compressor pump and preventing any recycling of the refrigerant.

Attempts to lessen the maintenance requirements by filtering the pressurized vapor before it passed through the compressor pump of the recovery unit led to another problem. To pass the volatile refrigerant through the newly developed filters required an increase in pressure. This increase in turn, required stronger filters. This ever increasing spiral eventually has led to the development of heavy armored filters. The increase in pressure required by the filters precipitated a concomitant increase in the wall thickness of the conduits used to transport the refrigerant. While these filters lengthened the life of the compressor pump, they added substantially to the weight of the recovery device, thereby making them difficult to transport.

Furthermore, because of the strength required to withstand the pressure and the need to be airtight, filters are often difficult to access. Cleaning these filters increases the maintenance needs of the refrigerant recovery device and service intervals are often difficult to determine owing to the variable amount of contaminant issuing from each disabled refrigeration unit.

Each possibly disabling malfunction of a refrigeration unit introduces differing amounts of impurities into the refrigerant. These impurities may rapidly build up to the point that the filter can no longer purify the gas or may become clogged. In the event that these filters become blocked, the requisite vacuum needed to draw materials through them will eventually overtax the pump, thereby damaging it or resulting in an explosion. These higher pressure systems expose technicians to the dangers of explosion and other risks such as eye and skin damage inherent with gases accidentally released under high pressure.

Further adding to the maintenance difficulties of these devices is the lack of any counting mechanism to remind technicians of the need to clean the filters and perform other maintenance chores. Several technicians may use the same refrigerant recovery device on jobs producing varying amounts of impurities to be filtered. This lack of ability to record usage, may lead to compressor failure due to clogging in the filters from lack of proper care and maintenance.

The weight of such recovery devices dictates that they be used mostly in commercial or industrial applications where a vehicle can be used to transport them to the appliance. Even so-called "portable" devices in use today weigh over 150 pounds and require permanent mounting to a two-wheel hand truck or dolly for transport, discouraging their use in apartments with stairs or in tight places.

The size of refrigerant recovery devices also discourages their use. Many of the refrigerant recovery devices transported by dolly or hand-truck, in addition to being very heavy are also unwieldy because of their size. It is difficult to maneuver a large device into the maintenance closets and back rooms that these refrigeration devices are often placed in. Additionally, refrigeration devices are often placed on roofs and in other locations requiring negotiation of tight turns and narrow stairways.

A further problem encountered by past devices as a result of the pressurized vapor has concerned the control of the flow throughout the recovery apparatus. Devices that vaporize refrigerant before reintroducing it to the repaired appliance require a separate routing of refrigerant to the vaporizer. This alternate route employs a plurality of valves to prevent back-flow and to control the flow of the refrigerant to the vaporizer. These valves have added to the complexity of refrigerant recovery systems and further discouraged the use of these devices for anything but large commercial operations. Indeed, the complexity may have actually led to mistakes further damaging the appliance to be repaired. The multiplicity of valves has also contributed to the high maintenance requirements of past devices and increased the danger of malfunction and possible injury to technicians.

A still further problem experienced by repair personnel has been the need to transport several devices to perform ancillary functions in the repair of refrigeration systems. As air, oil and other contaminants infiltrate a system, they form blockages that are not removed with the refrigerant. Accordingly, it is often necessary to use a separate device with the capacity to blow obstructions out of the system.

Still other devices often need to be transported to the repair site to monitor the system for leaks after repair and before the refrigerant is reintroduced. Repair personnel often need a separate device to evacuate the contaminated air in the system after repair. This practice subjects compressors to even further contact with contaminants and, as a result, shortens the maintenance interval and life of the compressor.

One significant current problem associated with reintroducing refrigerant into refrigeration systems concerns the use of heat-exchangers to vaporize the liquid refrigerant. Current systems utilize a joint condenser-/evaporator unit that requires additional valves to reroute the refrigerant back through the system. The evaporator and attendant valves add to the weight and complexity of recovery devices, thereby discouraging their frequent use and increasing the need for frequent maintenance. The increased complexity added to refrigerant recovery devices by these valves also contributes to the chance for error and possible accident in the repair of appliances and in any use of the refrigerant recovery device.

After vaporization, the gaseous refrigerant is usually slowly bled back into the refrigeration device or pumped into the low pressure side of the refrigeration device's compressor. Both methods are time consuming because they both require the vaporization of the refrigerant before reintroduction into the refrigeration device. As the refrigerant is converted to gaseous form, it must be slowly reintroduced so as not to be compressed in the refrigeration unit and converted to liquid before entering the compressor of the refrigeration unit. Too much liquid introduced into the low pressure side of the refrigerant unit's compressor could damage the compressor.

Another problem involving the time consumed in refrigeration unit repairs concerns the down-time, or period during which the refrigeration unit is inoperable. Refrigeration units used in the food industries are vital to the preservation of large amounts of inventory and often to the very operation of the business. Ice cream stores and many restaurants must close for business if the refrigeration system is disabled for any length of time.

From the foregoing, it will be appreciated that what is needed in the art are novel, lightweight, portable, refrigerant recovery apparatus and methods embodied in a single device for recovering refrigerants in which the refrigerant can be readily and safely evacuated, filtered, stored, and then reintroduced back into the refrigeration appliance or recycled for further use.

Additionally, it would be an advancement in the art to provide novel, lightweight, portable, refrigerant recovery apparatus and methods with few valves and controls so simple that its ease of operation would encourage its use and thereby preserve the environment from the deleterious effects of released refrigerant.

It would be a further advancement in the art to provide novel, lightweight, portable refrigerant recovery apparatus and methods that could be contained in one unit that was small and light enough to be easily carried into crowded maintenance rooms and through narrow openings and stairways.

It would be a further advancement in the art to provide a novel, lightweight, portable refrigerant recovery apparatus and methods that functions as a leak sensor to test the efficacy of repairs or in analysis of possible defects before repairs are begun.

It would be a further advancement in the art to provide a novel, lightweight, portable refrigerant recovery apparatus and methods for evacuating contaminants remaining in a depressurized system prior to reintroduction of clean refrigerant.

It would be a further advancement in the art to provide a novel, lightweight, portable refrigerant recovery apparatus and methods with capacity to blow out obstructions in a blocked system.

It would be a further advancement in the art to provide a novel, lightweight, portable refrigerant recovery apparatus and methods which require little maintenance through the use of lubricated-for-life components and disposable filters.

It would be a further advancement in the art to provide a novel, lightweight, portable refrigerant recovery apparatus and methods which provided a counting mechanism to remind the user when the disposable filter needed to be replaced.

It would be a further advancement in the art to provide a novel, lightweight, portable refrigerant recovery apparatus and methods that could quickly reintroduce refrigerant into repaired refrigeration units in a liquid form to the high pressure side of the compressor foregoing any need for an evaporator and its attendant valves and the slow reintroduction of the refrigerant in gaseous form.

It would be an additional advancement in the art to provide a novel, lightweight, portable refrigerant recovery apparatus and methods that could be used as a temporary refrigeration unit for maintaining operation of a business while repairs are being performed on a disabled refrigeration unit.

BRIEF SUMMARY AND OBJECTS OF THE INVENTION

The present invention is directed to novel apparatus and methods for recovering, purifying, and recycling refrigerants. More particularly, the present invention is directed to the recovery and recycling of refrigerant from appliances in a manner that is simple enough so that it encourages repair personnel to use the device even in smaller residential applications and thereby lessen the amount of refrigerant released into the atmosphere.

In the practice of the present invention, the refrigerant recovery system may be used separately, or in combination with the recharging, leak testing, obstruction removal, and/or vacuum systems. Both the retrieval and vacuum systems filter the incoming material through a disposable filter in order to provide for purification of the refrigerants.

Leak testing is accomplished through the use of a pressure gauge located intermediate the storage tank and the exit valve. By connecting the repaired refrigeration unit to the refrigerant recovery device with a temporary connecting means, pressure from the compressor can be introduced to the repaired system. The compressor can then be turned off and the pressure monitored by the pressure gauge for any deviation.

Blockages in a refrigeration unit can be blown out by connecting the compressor via a temporary connecting means to the refrigeration unit and allowing pressure to built up in the system. The safety switches located on the compressor will ensure that unsafe pressures are not exerted on the system while attempting to blow out obstructions.

According to the present invention, an electrically driven transfer pump, having an inlet at which vacuum is produced, selectively communicates with a refrigeration system such as is typically used with automotive air conditioning systems, home window or central air conditioning units, food cooling systems, and industrial cooling systems.

The pump outlet, at which pressure is produced, communicates with a condenser and then with a storage tank. In the presently preferred embodiment, a valve assembly may be used to allow a quantity of refrigerant exceeding the capacity of the storage tank to be diverted to an optional external holding tank during repairs on larger commercial refrigeration devices. The optional external tank may be removed from the device after filling for subsequent storage if the technician finds it necessary to delay repairs or if the device is beyond repair.

Safety is promoted through the use of a thermal fuse located intermediate the compressor and its electrical power source which fuse deactivates the compressor upon a thermal buildup often accompanying a pressure output higher than normal. Performing a redundant back-up function is a thermal switch built into the compressor operating in a similar manner to the thermal in-line fuse. A current overload switch located on the compressor, and a pressure safety switch located intermediate the compressor and condenser provide further electrical and pressure protection.

Portability is attained through the use of lightweight materials, by eliminating the need for an evaporator, and by overcoming the need for many of the valves and components necessary in older devices. A carrying handle is located in the case. The approximate weight of the presently preferred embodiment is therefore less than about sixty (60) pounds.

It is therefore, an object of the present invention to provide a novel, lightweight, portable refrigerant recovery apparatus and methods in which the refrigerant can be readily and safely evacuated, filtered, stored, and then reintroduced back into the refrigeration appliance or recycled for further use.

Another important object of the present invention is to provide a novel, lightweight, portable refrigerant recovery apparatus and methods with few valves and with controls so simple that they to encourage their use and thereby preserve the environment from the deleterious effects of the refrigerant that would otherwise be released into the atmosphere.

A further object of the present invention is to provide a novel, lightweight, portable refrigerant recovery apparatus and methods that are contained in one unit that is small and light enough to be easily carried into crowded maintenance rooms and through narrow openings and stairways.

Yet another important object of the present invention is to provide a novel, lightweight, portable refrigerant recovery apparatus and methods that use few valves, lubricated for life components and have few moving parts, and so require little maintenance.

Yet another important object of the present invention is to provide a novel, lightweight, portable refrigerant recovery apparatus and methods that functions as a leak sensor to test the efficacy of repairs or in analysis of possible defects before repairs are begun.

A further object of the present invention is to provide a novel, lightweight, portable refrigerant recovery apparatus and methods that operate as a vacuum pump for evacuating contaminants remaining in a depressurized system prior to reintroduction of clean refrigerant.

A still further object of the present invention is to provide a novel, lightweight, portable refrigerant recovery apparatus and methods capable of blowing out obstructions in a blocked system.

Another object of the present invention is to provide a novel, lightweight, portable refrigerant recovery apparatus and methods providing disposable filters and counting mechanisms to remind the user when the filter needs to be replaced.

An additional object of the present invention is to provide a novel, lightweight, portable refrigerant recovery into repaired refrigeration units in a liquid form to the high pressure side of the compressor in the repaired refrigeration unit.

A further object of the present invention is to provide a novel, lightweight, portable refrigerant recovery apparatus and methods that may be used as a refrigeration unit to temporarily replace a disabled refrigeration unit while that unit is being repaired thereby allowing a business to continue operations.

These and other objects and features of the present invention will become more fully apparent from the following description and appended claims, or may be learned by the practice of the invention.

DETAILED DESCRIPTION OF THE PREFERRED EMBODIMENT

The present invention provides a portable refrigerant recycling, purification, and storage system designed to be of such size and weight as to permit the system to be highly portable and therefore, easily carried by repair personnel to disabled refrigeration devices on-site.

Figure 1:
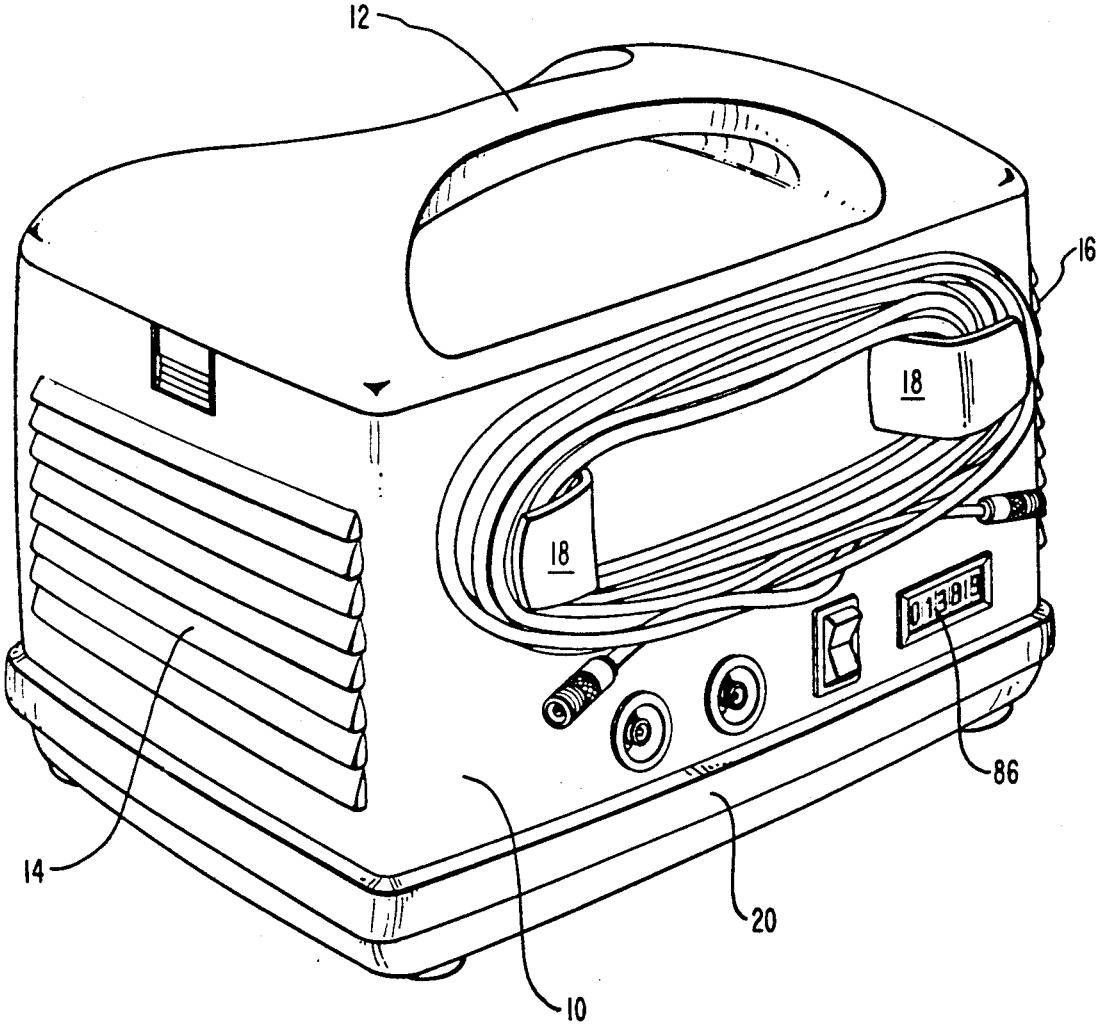
FIG. 1 is a schematic showing details of the refrigerant recovery, purification, monitoring and recharging functions of the present invention.

As shown in FIG. 1, the preferred embodiment of refrigerant recycling system 5 includes a case 10 provided to both protect the apparatus and to facilitate ease of transportation. The illustrated embodiment provides a carrying case 10 having a handle 12. A cooling air intake grill 14 and an exit grill 16 provide air flow to the interior of the case. A pair of cord retaining hooks 18 provide for storage of a power cord 9 and temporary connecting hoses 86, 88. A bumper strip 20 protects surrounding walls and other surfaces from damage due to inadvertent contact during transport. In the presently preferred embodiment, case 10 is constructed of stainless steel but it may be appreciated by those skilled in the art that other materials may be used. Stainless steel is preferred for its strength and resistance to corrosion while remaining lightweight.

Figure 2:
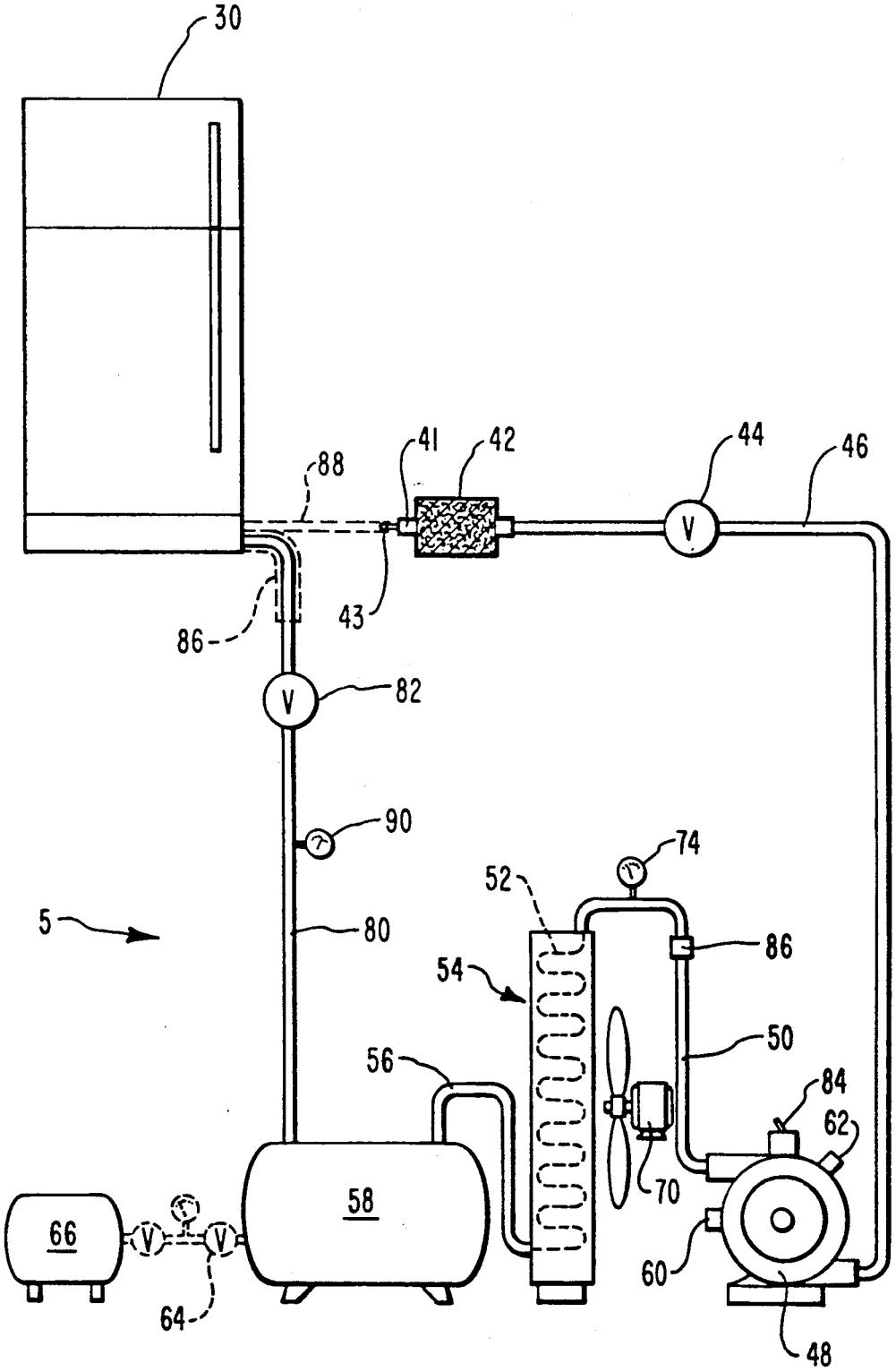
FIG. 2 is a perspective view illustrating a fiberglass or plastic housing for containing the system of the present invention as shown in FIG. 1.

As illustrated schematically in FIG. 2, the preferred embodiment of refrigerant recycling system 5 may be attached with temporary connecting hose 88 to a disabled refrigeration unit 30. Temporary connecting hose 88 is connected to the refrigerant recycling and recovery system 5 through a fitting 41 of a disposable, acid, moisture, and foreign particle filter 42.

Filter 42 filters incoming refrigerant before it is pressurized, thereby foregoing the previous weight problems associated with filters located after pressurization. By filtering out acid before it passes through a compressor pump 48, pump life is greatly extended and the system in general is relieved of the stresses produced from corrosion. Filter 42 filters out moisture present in the contaminated refrigerant which can lead to refrigerant recovery and recycling system component failure from rust and additionally must be removed to prevent contamination of refrigerant stored in the system. Filter 42 is affixed to a one-way Schraeder-type valve 43 to prevent the release of pressure and vapor to the atmosphere when attaching or detaching temporary connecting hose 88.

Opening inlet valve 44 allows the withdrawal of refrigerant from disabled refrigeration unit 30 for processing in refrigerant recovery and recycling system 5 by passing the vaporous mixture through a conduit 46 to a compressor pump 48. Compressor pump 48 is activated by a switch 84 which controls the compressor/vacuum functions of the refrigerant recovery and recycling system. It is preferred that switch 84 be a three-way switch, but it will be clear to one skilled in the art that a variable switch or another type may be used. It is desirable that the compressor pump preferably be of the positive displacement type, hermetically sealed, and lubricated for life to reduce maintenance.

An electro-mechanical counter 86 is provided to record the number of operations of the system for reference in replacing disposable filter 42. Disposable filter 42 requires replacement after a predetermined number of uses. As several individuals may use the refrigerant recovery and recycling system, it is desirable that the user be reminded when filter replacement becomes necessary.

A thermally activated switch 60 de-energizes compressor 48 when excessive heat has built-up due to pressure overload. The presently preferred embodiment utilizes a bi-metallic strip to break the electrical circuit at approximately 145 to 150 degrees Fahrenheit. Additionally, a redundant system using a current overload switch 62 communicates with compressor 48 to cut-off power should the pressure in the refrigerant recovery and recycling system build up to a dangerous level. In the presently preferred embodiment, a pressure cut-out operates at 220 pounds per square inch to deactivate the compressor before it reaches a level around 300 pounds per square inch considered dangerous. The refrigerant, after being compressed in compressor 48, is then discharged through a conduit 50 into a condensing coil 52 of a condenser 54 where the compressed gas is cooled to a liquid state. An electrically driven fan 70 is mounted adjacent condenser 54 to force ambient air over condensing coil 52.

The now liquefied refrigerant exits condensing coil 52 and passes through a conduit 56 to be stored in a receiving tank 58. In industrial applications where large refrigeration units are to be repaired, a valve such as that illustrated at 64 may be opened manually to allow excess refrigerant to be stored in a temporary storage tank such as illustrated at 66. Storage tank 66 may be a small portable tank for repair jobs comprising more than one refrigeration unit in a residence, or may be truck mounted for repairs on large commercial refrigeration units.

Contaminants such as oil, air, and particulate matter that have formed obstructions in the conduits of the disabled refrigeration device may be blown-out under high pressure by the following process:

1. Connect the refrigerant recovery and recycling apparatus to disabled refrigeration device 30 by temporary connecting hose 86;
2. emptying receiving tank 58 into temporary storage container 66;
3. open valve 44;
4. activate compressor 48 until pressure is built against an exit valve 82 after which said valve 82 may be opened to allow the charged mass of air to enter the disabled refrigeration unit 30 through a temporary connecting hose 86 thereby purging the system of obstructions.

After repairs have been accomplished, it may be desirable to test the disabled refrigeration unit for unseen leaks caused by corrosion or physical damage from a disintegrating compressor.

A pressure test may be performed on the repaired device by the following process:

1. Compressor 48 is selectively activated by switch 84 to the compressor mode and pressurizes air drawn into open valve 42;
2. pressurized air is passed through condenser 54 by way of conduit 50;
3. pressurized air then travels to receiving tank 58 through conduit 56;
4. then through a conduit 80 to an open valve 82 and into the repaired refrigeration unit 30.
5. A pressure gauge 90 monitors the pressure in conduit 80 after valve 44 has been closed and compressor 48 stopped.

It will be appreciated that a nitrogen or other gas cartridge may be attached to valve 42 to replace the air in the process described above to forego the next described step of replacing the air.

After refrigeration unit 30 is repaired, refrigerant recycling, purification and storage system 5 may be connected through a temporary connecting hose 88 to withdraw any air from the newly repaired system in preparation for recharging. Compressor 48 is activated in the vacuum mode by switch 84 to draw contaminated air from refrigeration unit 30 through disposable filter assembly 42 and conduit 46 to compressor 48. Thereafter, the air used to purge the system of obstructions is passed through conduit 50 to condenser 54 through conduit 56 to receiving tank 58. Air then passes through conduit 80 and exit valve 82 to the atmosphere.

To recharge a repaired refrigeration system, a portion of liquefied refrigerant is discharged from receiving tank 58 under ambient system pressure back into refrigeration unit 30. It will be appreciated by those skilled in the art that an expansion apparatus such as an expansion valve, venturi, or any other suitable pressure reducing mechanism may be employed at this point to vaporize the liquid refrigerant before it passes through conduit 80 to valve 82 which is then opened into the repaired refrigeration unit 30. This system is time consuming and requires the additional weight of a device to vaporize the refrigerant. The present invention alleviates the need to carry a separate device to vaporize the refrigerant by providing a method for reinjecting the refrigerant into a repaired device in its liquid form.

If a liquid charge method is preferred, the presently preferred embodiment can accomplish this by closing valve 44 and allowing compressor 48 to pressurize the refrigerant recovery and recycling system to approximately 50-150 pounds per square inch.. Exit valve 82 is then attached to the high pressure side of the non-activated compressor of refrigeration 24 unit 30, by a temporary connecting hose 86 and quickly opened to inject the liquid refrigerant into refrigeration unit 30. A pressure safety control valve 74 is located on conduit 50 to deactivate compressor 48 and mechanically release pressure from conduit 50 should an excess of pressure be generated. It is preferred that the pressure not exceed 220 pounds per square inch.

By using the quick-charge method of reinjecting refrigerant into repaired refrigeration units, the need for a vaporization device is removed and the method is much faster than the previously used method of slowly reintroducing vaporized refrigerant into the refrigeration unit.

To operate the refrigerant recovery and recycling apparatus to temporarily replace a disabled refrigeration unit, temporary connecting hose 88 is attached to the suction side of the conduit system employed by the disabled refrigeration unit. Temporary connecting hose 86 is attached to the pressure side of the disabled compressor. In this configuration, the disabled compressor is bypassed and the temporary compressor serves as its surrogate until the disabled unit can be repaired.

From the foregoing, it will be appreciated that the present invention provides novel apparatus and methods for refrigerant recovery and recycling utilizing a device that is small, lightweight, mechanically dependable and versatile. Additionally, the present invention provides a device wherein refrigerant can be readily and safely evacuated, filtered, stored, and then reintroduced back into the refrigeration unit or recycled for further use.

The present invention also provides a unique system with few valves and with controls so simple that they encourage their use and thereby preserve the environment from the deleterious effects of the refrigerant that would otherwise be released into the atmosphere were the device too complex to easily use. Indeed, the entire instruction sequence may be printed on a sticker to be applied to the case of the present invention.

The present invention is small and light enough to be easily carried into crowded maintenance rooms and through narrow openings and stairways and is mechanically dependable because it has few valves, uses lubricated for life components such as the compressor pump and fan motor and it has few moving parts. The present invention also provides disposable filters and counting mechanisms to remind the user when the filter needs to be replaced. The counting mechanism is electromechanically operated to record the number of uses of the invention thereby allowing infrequent or multiple users instant data on the number of uses since the last filter change.

The present invention provides an apparatus that functions as a leak sensor to test the efficacy of repairs or in analysis of possible defects before repairs are begun. By injecting nitrogen gas into the disabled refrigeration unit under pressure, the invention allows monitoring of any decrease in pressure due to leakage.

The present invention operates as a vacuum pump for evacuating contaminants remaining in a depressurized system prior to reintroduction of clean refrigerant and is also capable of blowing out obstructions in a blocked system. The present invention can quickly reintroduce refrigerant into repaired refrigeration units in a liquid form to the high pressure side of the compressor in the repaired refrigeration unit by building up pressure in the invention, then quickly injecting the liquid refrigerant.

The present invention provides for apparatus and methods that may be used as a refrigeration unit to temporarily replace a disabled refrigeration unit while that unit is being repaired thereby allowing a business to continue operations.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by the United States Letters Patent is:

1. A refrigerant utility device for recovery, recycling, purification or storaging of gaseous and liquid refrigerant from disabled refrigeration units, the refrigerant utility apparatus comprising, in combination:

(a) a pump having a vacuum producing inlet and a pressure producing outlet, the pump being a hermetically sealed, lubricated-for-life positive displacement pump;

(b) cleansing means for cleansing of the gaseous and liquid refrigerant, the cleansing means comprising a disposably porous stone filter with carboniferous activated charcoal packing, the cleansing means located prior in line to the pump in order to remove contaminants and impurities before exposure to the pump, the cleansing means being exteriorly located for accessible servicing;

(c) a condenser;

(d) receiving tank for holding recovered refrigerant; and (e) a valve and conduit system for interconnecting the disabled refrigeration unit, cleansing means, pump and condenser, configured so as to avoid contamination of the pump and condenser, the valve and conduit system comprising a first valve and conduit system for connecting the pump with a disabled refrigeration unit, and a condensor and second conduit system for transporting recovered refrigerant from the pump to the condensor, the valve and conduit system further comprising a second valve and fourth conduit system for transporting refrigerant from the receiving tank to the second valve.

2. A refrigerant utility device for recovery, recycling, purification or storaging of gaseous and liquid refrigerant from disabled refrigeration units, the refrigerant utility apparatus comprising, in combination:

(a) a pump having a vacuum producing inlet and a pressure producing outlet, the pump being a hermetically sealed, lubricated-for-life positive displacement pump;

(b) cleansing means for cleansing of the gaseous and liquid refrigerant, the cleansing means comprising a disposably porous stone filter with carboniferous activated charcoal packing, the cleansing means located prior in line to the pump in order to remove contaminants and impurities before exposure to the pump, the cleansing means being exteriorly located for accessible servicing;

(c) a condenser;

(d) receiving tank for holding recovered refrigerant; and (e) a valve and conduit system for interconnecting the disabled refrigeration unit, cleansing means, pump and condenser, configured so as to avoid contamination of the pump and condenser, the valve and conduit system comprising a first valve and conduit system for connecting the pump with a disabled refrigeration unit, and a condenser and second conduit system for transporting recovered refrigerant from the pump to the condensor, the valve and conduit system further comprising a second vale and fourth conduit system for transporting recovered refrigerant from the receiving tank to the second valve, the valve and conduit system further comprising a third conduit system for transporting liquefied refrigerant from the condenser to the receiving tank.

3. A refrigerant utility apparatus for recovering, recycling, purifying or storing of gaseous and liquid refrigerant obtained from disabled refrigerant units, the refrigerant utility apparatus comprising, in combination:

(a) a pump having a vacuum producing inlet and a pressure producing outlet, the pump being a hermetically sealed, lubricated-for-life, positive displacement pump;

(b) cleansing means for cleansing of the gaseous and liquid refrigerant, the cleansing means located prior in line to the pump in order to remove contaminants and impurities before exposure to the pump;

(c) a condenser;

(d) a valve and conduit system for interconnecting the disabled refrigeration unit, cleansing means, pump and condenser, configured so as to avoid contamination of the pump and condenser; and (e) means for pressurizing and storing air and means for circulating the pressurized air through the disabled refrigerant unit in order to identify leaks or remove obstructions in the system.

4. A refrigerant utility device for recovery, recycling, purification, or storaging of gaseous and liquid refrigerant from disabled refrigeration units as defined in claim 3, wherein the cleansing means comprise a disposable filter capable of removing the contaminants and impurities from the gaseous and liquid refrigerant.

5. A refrigerant utility device for recovery, recycling, purification, or storaging of gaseous and liquid refrigerant from disabled refrigeration units as defined in claim 3, wherein the pressurizing and storing means and the circulating means comprises a receiving tank for holding gaseous and liquid refrigerant recovered from the disabled refrigerant units.

6. A refrigerant utility device for recovery, recycling, purification, or storaging of gaseous and liquid refrigerant from disabled refrigeration units as defined in claim 3, further comprising a housing for carrying and protecting the device.

7. A refrigerant utility device for recovery, recycling, purification, or storaging of gaseous and liquid refrigerant from disabled refrigeration units as defined in claim 3, wherein the cleansing means comprises a disposably porous stone filter with carboniferous activated charcoal packing.

8. A refrigerant utility device for recovery, recycling, purification, or storaging of gaseous and liquid refrigerant from disabled refrigeration units as defined in claim 5, wherein the valve and conduit system comprises:

a first valve and conduit system for connecting the pump with a disabled refrigeration unit; and a condensor and second conduit system for transporting recovered refrigerant from the pump to the condenser.

9. A refrigerant utility device for recovery, recycling, purification, or storaging of gaseous and liquid refrigerant from disabled refrigeration units as defined in claim 5, wherein the valve and conduit system comprises a second valve and fourth conduit system for transporting recovered refrigerant from the receiving tank to the second valve.

10. A refrigerant utility device for recovery, recycling, purification, or storaging of gaseous and liquid refrigerant from disabled refrigeration units as defined in claim 5, wherein the valve and conduit system comprises a third conduit system for transporting recovered refrigerant from the condenser to the receiving tank.

* * * * *

UNITED STATES PATENT AND TRADEMARK OFFICE

CERTIFICATE OF CORRECTION

PATENT NO. : 5,138,847

DATED : August 18, 1992

INVENTOR(S) : SCOTT S. ROLLINS

It is certified that error appears in the above-identified patent and that said Letters Patent is hereby corrected as shown below:

Abstract, line 18, "lightweight" should be --light weight--
Column 5, line 7, "built" should be --build--
Column 5, line 56, delete "to"
Column 9, line 7, "inch.." should be --inch.--
Column 10, line 51, "condensor" should be --condenser--
Column 11, line 17, "condensor" should be --condenser--
Column 11, line 19, "vale" should be --valve--
Column 12, line 2, "storaging" should be --storing--
Column 12, line 4, "comprise " should be --comprises--
Column 12, line 8, "storaging" should be --storing--
Column 12, line 15, "storaging" should be --storing--
Column 12, line 20, "storaging" should be --storing--
Column 12, line 26, "storaging" should be --storing--
Column 12, line 35, "storaging" should be --storing--
Column 12, line 42, "storaging" should be --storing--
Column 10, line 53, "condensor" should read --condenser--

Signed and Sealed this

Ninth Day of August, 1994

*Attest:*

Bruce Lehman

BRUCE LEHMAN

*Attesting Officer*

*Commissioner of Patents and Trademarks*